US005325658A

United States Patent [19]

Stahlecker

[11] Patent Number: 5,325,658

[45] Date of Patent: Jul. 5, 1994

[54] SPINNING MACHINE WITH FALSE-TWISTING DEVICES

[75] Inventor: Gerd Stahlecker, Eislingen/Fils, Fed. Rep. of Germany

[73] Assignees: Fritz Stahlecker; Hans Stahlecker, Fed. Rep. of Germany

[21] Appl. No.: 871,125

[22] Filed: Apr. 20, 1992

[30] Foreign Application Priority Data

Jul. 6, 1991 [DE] Fed. Rep. of Germany ..... 4122463

[51] Int. Cl.[5] ..... D01H 13/04

[52] U.S. Cl. ..... 57/90; 57/328

[58] Field of Search ..... 57/90, 315, 341, 343, 57/328

[56] References Cited

U.S. PATENT DOCUMENTS

| | | | |
|---|---|---|---|
| 2,097,540 | 11/1937 | Tracy | 57/328 |
| 2,256,436 | 9/1941 | Kruse | 57/328 X |
| 2,619,790 | 12/1952 | Hardacre et al. | 57/343 |
| 2,710,428 | 6/1955 | Nutter et al. | 57/315 X |
| 2,936,567 | 5/1960 | Russell et al. | 57/341 X |
| 3,564,829 | 2/1971 | Tsuzuki | 57/90 X |
| 3,727,391 | 4/1973 | Hiserman et al. | 57/315 |
| 4,700,538 | 10/1987 | Varga et al. | 57/328 X |

FOREIGN PATENT DOCUMENTS

| | | |
|---|---|---|
| 0041484 | 12/1981 | European Pat. Off. . |
| 1785481 | 6/1971 | Fed. Rep. of Germany . |
| 1015780 | 1/1966 | United Kingdom . |

*Primary Examiner*—Joseph J. Hail, III

*Attorney, Agent, or Firm*—Evenson, McKeown, Edwards & Lenahan

[57] ABSTRACT

In the case of a spinning machine having several spinning stations, which comprise drafting units, for the spinning of slivers fed in cans, false-twisting elements are connected in front of the drafting units which provide the slivers with a protective twist.

12 Claims, 2 Drawing Sheets

9
16
18
19

50
B
C
8
27
25
26
50
17
A
6
7
10
M
3
2
YD
1
5
D
4
14
11
13
12
15

20
23
24
B,C
21
22
6
16,17

SPINNING MACHINE WITH FALSE-TWISTING DEVICES

BACKGROUND AND SUMMARY OF THE INVENTION

This invention relates to a spinning machine having several spinning stations for the spinning of slivers fed in cans into yarns, having guiding devices for the guiding of the slivers from the cans to drafting units pertaining to the spinning stations and having devices for protecting the slivers on their transport path.

It is known (British Patent Document GB 1 015 780) to feed slivers to a ring spinning machine in cans, withdraw them by way of rollers and then guide them to pairs of transport belts which receive the slivers between one another and transport them to the drafting units of the individual spinning stations. Transport belts of this type require high expenditures.

In the case of a ring spinning machine with package feeding, it is known (European Patent Document EP-0 041 484 B1) to guide the roving by way of a stationary spiral which is to provide a false twist to the roving and thus provide it with a higher strength.

Similar stationary false-twisting elements are also known in the case of roving frames (German Patent Document DE-OS 1 785 481) in which slivers are guided from cans to the drafting rollers.

In the older German Patent Application P 40 38 231.1, which is no prior publication, it was suggested to provide the slivers during the withdrawal from the cans with a true twist in that the cans are rotated about their axes.

It is an object of the invention to feed also finer slivers from cans, of a size range of from Nm 0.3 to 0.8, to a spinning machine, in which case these slivers are sufficiently protected on their transport path and, if possible, are no longer provided with a twist when entering into the drafting units, and the expenditures for protecting the slivers are as low as possible.

This object is achieved according to preferred embodiments of the invention in that false-twisting elements are provided as the devices for the protecting of the slivers which are connected directly in front of the drafting units.

During their transport path, the slivers are provided with a sufficient number of twists by means of the false-twisting elements so that they are strengthened to such an extent that they are protected against faulty drafts. Very long transport paths can be bridged in this manner. After leaving the false-twisting elements, thus when entering the drafting units pertaining to the spinning stations, the slivers will again be largely untwisted because, as is known, the false twist opens up again behind the false-twisting elements. However, the transport path between the false-twisting elements and the drafting units is only short and withstood by the slivers without suffering any damage. It is advantageous for the fibers of the slivers to again be directed in parallel when entering into the drafting units.

In a development of the invention, the guiding devices each have a deflecting guide which divides the transport path of the slivers into two essentially linear strands and to which a false-twisting element is also assigned. Such a deflecting guide makes it possible, for example, to deposit cans next to the spinning machine while leaving an operating aisle and to guide the slivers, in the manner of a roof, over the aisle to the spinning stations. The additional false-twisting element connected in front of the deflecting guide provides a sufficient protective twist also between the can and the deflecting guide because it cannot simply be assumed that the false twist running back from the false-twisting elements of the drafting units will propagate by way of the deflecting guides.

The false-twisting element assigned to the deflecting guide may be directly connected in front of the deflecting guide. However, as an alternative, it is also possible to design the false-twisting element itself as a deflecting guide. In this case, the false twisting element provides the sliver not only with the protective twist but is also used for the guiding of the sliver.

Expediently, the false-twisting elements are drivable. It is therefore possible to adapt the magnitude of the false twist to the respective fiber material.

Advantageously, feeding rollers situated in front of the pertaining false-twisting elements are connected in front of the drafting units, the delivery speed of the feeding rollers preferably being 5% lower than the feeding speed of the drafting unit. Thus, the circumstance is taken into account that the slivers are shortened as a result of the false twist and are lengthened again correspondingly behind the false twisting elements. When feeding rollers are present, it is therefore necessary to coordinate the speeds of the feeding rollers with the speeds of the feeding rollers of the drafting unit with respect to one another. Such a coordination does not present any problems technically but this aspect has to be taken into account.

Other objects, advantages and novel features of the present invention will become apparent from the following detailed description of the invention when considered in conjunction with the accompanying drawings.

DETAILED DESCRIPTION OF THE DRAWINGS

Figure 1:
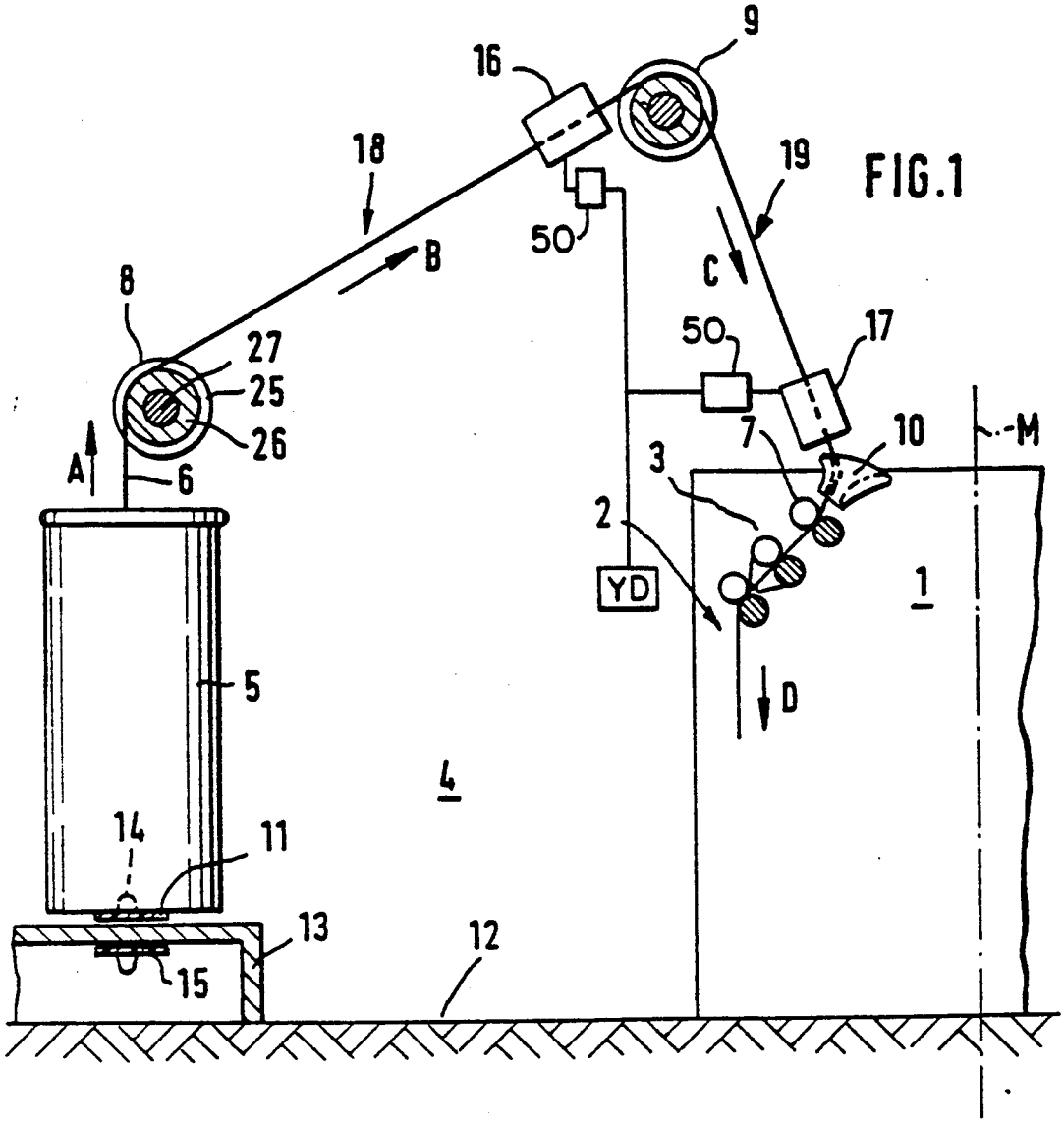
FIG. 1 is a partial cross-sectional view of a machine system with a spinning machine with spinning stations to which one sliver respectively is fed by means of a can, a total of two false-twisting elements for providing a protective twist being assigned to each sliver, constructed according to a preferred embodiment of the invention.

The spinning machine 1, which is shown only schematically in FIG. 1, is provided on both sides of its longitudinal center plane M on each side of the machine with a plurality of spinning stations 2 arranged next to one another. Of the spinning stations, only one three-cylinder drafting unit is illustrated.

In front of the spinning stations 2, an operating aisle 4 is situated for operating personnel. On the side of the operating aisle 4 opposite the spinning machine 1, cans 5 are deposited which, in a manner not shown in detail, may be arranged in several rows. The cans 5 contain the fiber material which is spun by the spinning stations 2.

The fiber material is fed to the spinning stations 2 as a sliver 6 produced on a drafting frame. The slivers have a size of approximately Nm 0.3 to 0.8 so that they can be drafted to the desired yarn size by the three-cylinder drafting units 3, in which case the respective pair of feeding rollers 7 nevertheless rotates at a sufficient rotational speed so that a concentricity is ensured.

The relatively fine slivers 6 are withdrawn from the cans 5 in the direction of the arrow A by a feeding roller 8, are then transported in the direction of the arrow B over the operating aisle 4 to another feeding roller 9 which is used as a deflecting guide, and are then in the direction of the arrow C essentially vertically fed to the pertaining drafting unit 3 in front of which the sliver guide 10 is connected. The slivers 6 drafted in the drafting units 3 are then fed in the direction of the arrow D to a twisting element, such as a ring spindle, which is not shown.

The cans 5 stand on conveyer belts 11 extending in the longitudinal direction of the machine which are placed in a platform 13 arranged slightly above the floor 12. The conveyor belts 11 are provided with button-type take-along devices 14 which reach behind the inner lower edge of the normally slightly elevated bottoms of the cans 5 and thus take them along with a certain form closure, convey them and hold them in the desired position. By means of the conveyor belts 11, which slide on the platform 13 and the returning run 15 of which is guided back below the platform 13, an automated supply and removal of the cans 5 can be realized, in which case the cans 5, after a stoppage of the conveyer belts 11, automatically stop in the correct position in which they remain during the spinning process.

On the relatively long transport path of the slivers 6, there is the danger of faulty drafts which later cause size fluctuations in the produced yarns. For this reason, it is provided to protect the slivers 6 during their transport path against such faulty drafts.

In the area in front of the feeding roller 9, a false-twisting element 16 is situated. Another false-twisting element 17 is connected in front of the respective drafting unit 3. This arrangement has the result that the individual slivers 6 are in each case provided with a protective twist between the feeding roller 8 and the false-twisting element 16 as well as between the feeding roller 9 and the false-twisting element 17. In this case, it may be provided to select the magnitude of the protective false twist to be identical on both strand sections 18 and 19 of the slivers 6. In this case, the slivers 6 are strengthened to such an extent that they are protected against faulty drafts. In this manner, a very long transport path can be bridged with the choice of the depositing of the cans 5 being completely free, and the cans 5 may also be deposited as desired or required on an elevated platform.

The false-twisting element 17, which is connected directly in front of the drafting unit 3, is situated very close to the sliver guide 10 so that the distance between the false-twisting element 17 and the pair of feeding rollers 7, where the sliver 6 is essentially not protected by a false twist, becomes as small as possible. Since the false twist produced by the false-twisting element 17 does not necessarily reach beyond the feeding roller 9, which to a certain extent acts as a twisting block, it is provided that a second twisting element 16 is disposed directly in front of the feeding roller 9. In this case also, the distance between the false-twisting element 16 and the feeding roller 9 should be as short as possible because the sliver 6 is largely untwisted in this area. Finally, it is also useful to mount the feeding roller 8 very closely above the upper opening of the can 5 because the sliver 6 is virtually not yet protected by the false twist also between the can 5 and the feeding roller 8.

It is important that, before entering into the respective feeding roller pair 7 of the drafting unit 3, the slivers 6 are virtually without any twist. Therefore, despite the previously provided protective twist, the fibers of the sliver 6 are again aligned in parallel and not, as in the case of flyer rovings, spirally in parallel.

Figure 2:
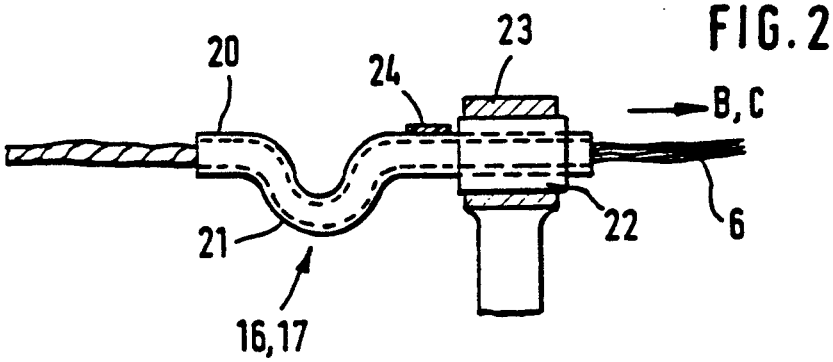
FIG. 2 is an enlarged representation of a false-twisting element according to FIG. 1.

A false-twisting element 16 and 17 is illustrated in FIG. 2. This is a simple tube 20 which has a crank-type deflection 21 and can be rotated in a bearing 22. The bearing 22 is inserted in a holder 23 which can be fastened on a longitudinal rail extending in the longitudinal direction of the machine.

For the driving of the false-twisting element 16, 17, a narrow driving belt 24 which extends in the longitudinal direction of the spinning machine 1 is sufficient. A narrow toothed belt may also be used which is, for example, 10 mm wide, and the tube 20 may be equipped with a small toothed wheel. In the embodiment according to FIG. 2, the driving belt 24 acts directly on the tube 20. So that contact pressure rollers are not required, the driving belt 24 may extend in a slalom-type manner; that is, in the case of one tube 20, it may rest against the top and in the case of an adjacent tube 20, it may rest against the bottom.

It is quite safe for the false-twisting elements 16, 17 to extend from one spinning station 2 to the next alternately around the left or the right. Since the false twist opens up again before the slivers 6 enter into the drafting units 3, it is not important whether the protective twist is a right-hand twist or a left-hand twist. It has the same strengthening protective effect in any case.

The false-twisting element 16, 17 shown in FIG. 2 is only an example. All kinds of false-twisting elements may be used which are known from the state of the art.

It is a basic idea that the sliver 6, which is too weak for the transport, is strengthened by means of a false twist for a short time, thus during the transport, in which case one or several false-twisting elements 16, 17 are used for each spinning station 2. In this case, the false-twisting elements 16, 17 must each be mounted on the end of the strand sections 18, 19 to be protected. The introducing of the slivers may take place by using suction air pistols. Care will be taken that the slivers 6 never travel completely out of the cans 5, and an exchange of cans will also be carried out sufficiently early so that a threading of the slivers 6 through the false-twisting elements 16, 17 is an operation that occurs relatively infrequently. As a result of the fact the false twist opens up in time in front of the pair of feeding rollers 7, the sliver 6 retains its good drafting capacity.

It may also be advantageous to assign stopping devices 50 to the false-twisting elements 16, 17. These may, for example, be designed such that a small sliding lever exists on each spinning station 2 which, as required, lifts the driving belt 24 from the tube 20 of the false-twisting element 16, 17. Since the tubes 20 rotate very slowly, a simple bearing will be sufficient and may possibly even permit that the driving belt 24 for a short time drags over the rounded edge of a lifting lever. Such stopping devices 50 may be electrically coupled with a yarn detector YD of the spinning station 2. The arrangement may also be set up in such a manner that the stopping devices 50 may be operated by the operating personnel in that a button is pushed, in which case, it is best to mount the push buttons or switches in the proximity of the pertaining drafting unit 3.

The feeding rollers 8 and 9 are individual rollers 26 which are each provided with side rims 25 and are non-rotatably mounted on a drive shaft 27 which extends through in the longitudinal direction of the machine and is driven in a gearhead of the spinning machine 1.

Figure 3:
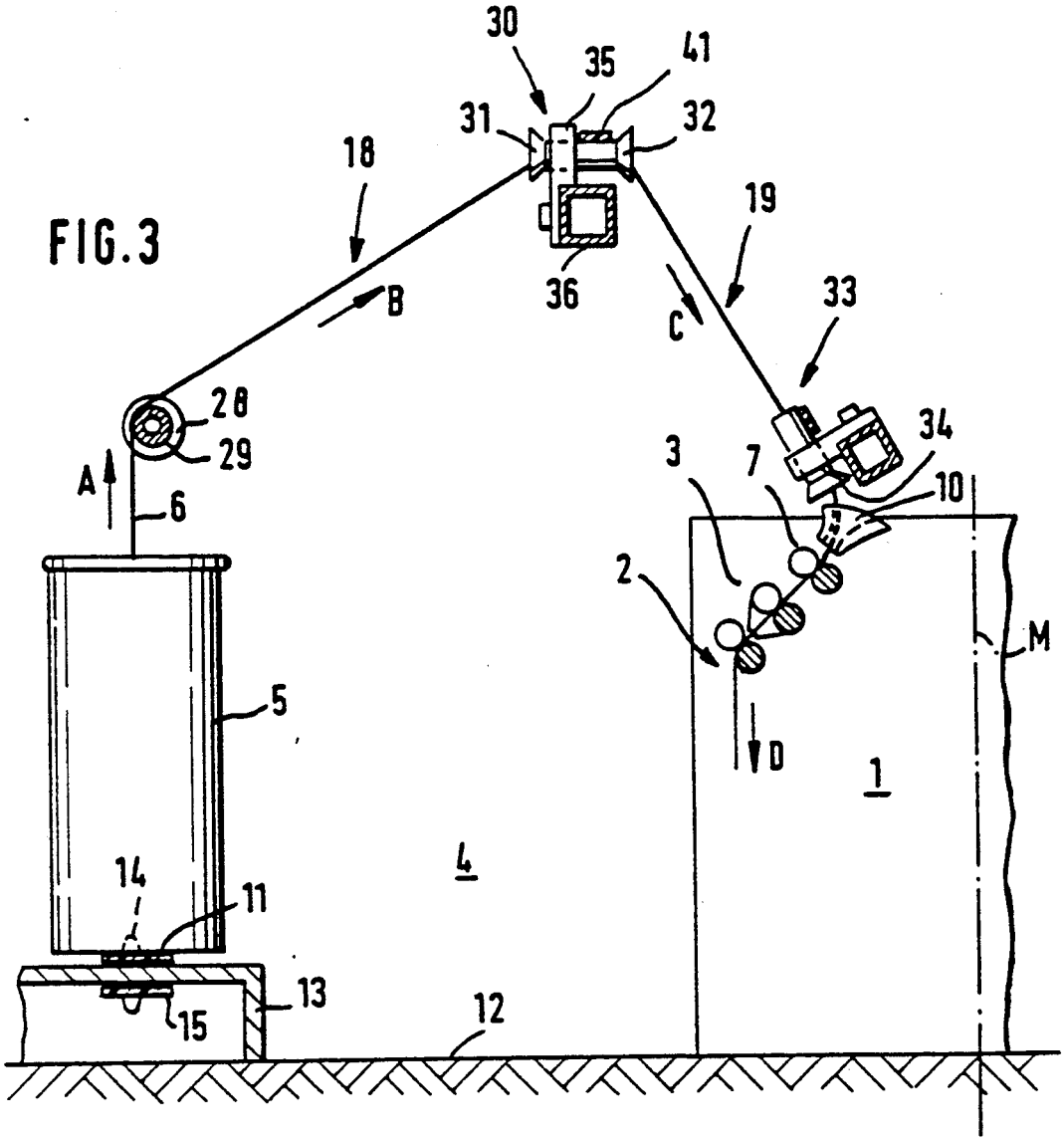
FIG. 3 is a partial view similar to FIG. 1 with a deflecting guide assigned to 'the slivers which, at the same time, is a false-twisting element, constructed according to another preferred embodiment of the invention.
Figure 4:
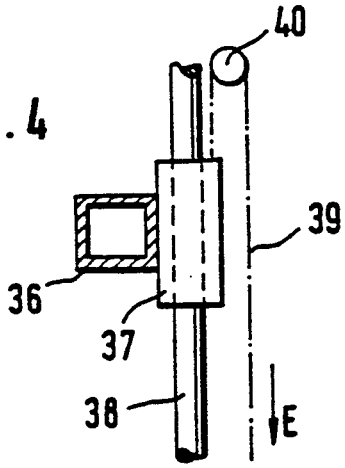
FIG. 4 is a view of a detail of FIG. 3 with a vertically adjustable holding device for a false-twisting element.

In the embodiment according to FIGS. 3 and 4, the same reference numbers were used for comparable components. In the following, these components will therefore not be described again.

In the embodiment according to FIG. 3, instead of the feeding roller 8 of FIG. 1, a tube 29 is provided above the can 5 which is provided with side rims 28 and can stand or rotate but is not drivable. The sliver 6 is therefore transported essentially by the feeding roller pair 7 of the drafting unit 3.

The sliver 6 travels through a false-twisting element 30 which has a bell-mouth-type inlet 31 and a bell-mouth-type outlet 32. By means of this arrangement, an additional deflecting roller is avoided above the aisle 4 because the false-twisting element 30 also takes over the function of the deflecting guide. At the end of the false-twisting course directly in front of the feeding roller pair 7, another false-twisting element 33 of the same type is situated. In addition to the saving of the upper deflecting guide, the arrangement according to FIG. 3 has the additional advantage that the sliver 6 is protected by a protective twist virtually along the whole transport path between the tube 29 and the false-twisting element 33. The false-twisting element 33 connected in front of the drafting unit 3 has the bell-mouth shape only on its outlet 34 because a slight deflection of the sliver 6 exists only in the direction of the drafting unit 3.

Both false-twisting elements 30 and 33 are each disposed in a holder 35 which, in turn, is fastened to a longitudinal crosshead 36. The longitudinal crossheads 36 are supported on the floor 12 corresponding to the machine sections. In this case, it may be provided to design the longitudinal crossheads in a vertically adjustable manner, as illustrated in FIG. 4.

According to FIG. 4, a sliding muff 37 is fastened to the longitudinal crosshead 36 and can be moved along a supporting rod 38. There is a chain pulling device 39 which is guided around a deflecting pulley 40 and on which the individual sliding muffs 37 are suspended. Thus, the possibility exists to move the longitudinal crosshead 36 from a central point or in sections upward or downward as required. This may be expedient, for example, when a sliver 6 must be threaded through the false twisting element 30. In this case, the longitudinal crosshead 36 is moved so far downward that it is easy for the operating personnel to carry out the threading operation.

The false twisting elements 30 and 33 are essentially constructed again as tubes which can be driven on their exterior surface by a tangential belt 41.

As an alternative for the driving of the false twisting elements 30 and 33, very simple miniature motors can be used and nowadays can be manufactured at low cost. The precise rotational speed of the false-twisting elements 30 and 33 is not important because it is a temporary protective twist which with respect to the spinning technology is not significant.

When the spinning machine 1 is started, it is advantageous to briefly manually twist together the slivers 6 before they are pulled through the false-twisting elements 30 and 33, as generally customary nowadays on the flyer.

With a view to a uniform moving-out of all cans 5 of a spinning machine 1, it is advantageous in the case of a yarn breakage to let the respective sliver 6 continue to travel into the drafting unit 3 even if it is not spun. It may then temporarily travel into a suction tube which is not shown and is assigned to the drafting unit 3, as is frequently customary in the case of ring spinning machines.

In the case of a corresponding design, it may be assumed that the false-twisting element 30 to a certain degree has an effect that extends into the can 5. Although the tube 29 is a twisting brake, it is no twisting stop. The short area between the can 5 and the tube 29 will then be slightly less twisted than the strand section 18 of the sliver 6.

With respect to faulty drafts, the strand section 18 is most dangerous. The rotational speed of the false-twisting element 30 must therefore be adjusted such that the sliver 6 receives a sufficient number of twists per meter, for example, 50 twists or slightly less. This depends on the strength of the respective sliver 6. The second vertical strand section 19 is slightly less dangerous but advantageously should receive the same number of rotations as the first strand section 18. After leaving the false-twisting element 33, the sliver 6 will be untwisted again so that it can easily be drafted.

This false twist shortens the sliver 6. This is not very important in the case of the variant according to FIG. 3 because the transport of the sliver 6 is essentially commanded by the pair of feeding rollers 7 of the drafting unit 3. However, in the case of the variant according to FIG. 1, the pair of feeding rollers 7 must be coordinated with the feeding rollers 8 and 9. It is therefore important to let the drafting unit 3 run by an amount of approximately 5 percent faster than the feeding roller 9 because, after the false twist opens up behind the false-twisting element 17, a loop would form after a short time.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A ring spinning machine comprising:

a plurality of spinning stations which each contain a three-cylinder drafting unit;

guiding devices which are between cans containing sliver and the drafting units wherein slivers are in the range from 0.3 to 0.8 Nm, with one sliver respectively being withdrawn from one of the cans and fed to the drafting units by the guiding devices, the guiding devices forming at least one deflecting guide for the slivers so that the slivers are withdrawn from the cans in the upward direction and are then deflected downward to the pertaining drafting units;

first mechanical false-twisting devices for each sliver arranged in the area of the deflecting guide, said first false-twisting devices providing the respective sliver with a false twist which at least partially runs back to the can from which the sliver was withdrawn; and second mechanical false-twisting devices for each sliver arranged directly in front of the drafting units, said second false-twisting devices providing a false twist to the respective sliver which runs back to the deflecting guide, wherein feeding rollers which are situated in front of the pertaining false-twisting elements are connected in front of the drafting units and the delivery speed of these feeding rollers is approximately 5 percent lower than the feeding speed of the drafting units.

2. A spinning machine according to claim 1, wherein the guiding devices each comprise a deflecting guide which divides the transport path of the slivers into two essentially linear strand sections, and wherein the false-twisting elements include a false-twisting element assigned to the deflecting guide.

3. A spinning machine according to claim 1, wherein the first false-twisting element is connected directly in front of the deflecting guide.

4. A spinning machine according to claim 1, wherein the false-twisting elements are connectable to driving means.

5. A spinning machine according to claim 1, wherein the false-twisting element itself forms the deflecting guide.

6. A spinning machine according to claim 5, wherein the false-twisting elements are drivable.

7. A spinning machine according to claim 1, wherein the false-twisting elements are connectable to driving means.

8. A spinning machine according to claim 1, wherein the false-twisting elements are connectable to driving means.

9. A spinning machine according to claim 1, wherein the guiding devices include a deflecting guide for each spinning station which divides the sliver transport path into two essentially linear strand sections.

10. A spinning machine according to claim 9, wherein the false-twisting devices include a first false-twisting element disposed immediately upstream of the pertaining deflecting guide.

11. A spinning machine according to claim 10, wherein the false-twisting devices include a second false-twisting element disposed adjacent an upstream end of a pertaining drafting unit.

12. A spinning machine comprising:

a plurality of spinning stations which each contain a three-cylinder drafting unit;

guiding devices which are between cans containing sliver and the drafting units wherein slivers are in the range from 0.3 to 0.8 Nm, with one sliver respectively being withdrawn from one of the cans and fed to the drafting units by the guiding devices, the guiding devices forming at least one deflecting guide for the slivers so that the slivers are withdrawn from the cans in the upward direction and are then deflected downward to the pertaining drafting units;

first driveable false-twisting devices for each sliver arranged in the area of the deflecting guide, said first false-twisting devices providing the respective sliver with a false twist which at least partially runs back to the can from which the sliver was withdrawn;

second driveable false-twisting devices for each sliver arranged directly in front of the drafting units, said second false-twisting devices providing a false twist to the respective sliver which runs back to the deflecting guide; and means for driving the first and second false-twisting devices, for detecting a yarn break and for stopping the driving of the first and second false-twisting devices in response to the detected interruption of yarn production.

* * * * *